US010233722B2

(12) United States Patent
Tang et al.

(10) Patent No.: US 10,233,722 B2
(45) Date of Patent: Mar. 19, 2019

(54) MOVING-ROTATING LINEAR COVERING TOOL

(71) Applicant: JIANGSU UNIVERSITY OF SCIENCE AND TECHNOLOGY, Jiangsu (CN)

(72) Inventors: Wenxian Tang, Jiangsu (CN); Jian Zhang, Jiangsu (CN); Shijie Su, Jiangsu (CN); Hua Li, Jiangsu (CN); Yuan Li, Jiangsu (CN); Yun Chen, Jiangsu (CN); Shuyan Wang, Jiangsu (CN)

(73) Assignee: JIANGSU UNIVERSITY OF SCIENCE AND TECHNOLOGY, Jiangsu (CN)

( * ) Notice: Subject to any disclaimer, the term of this patent is extended or adjusted under 35 U.S.C. 154(b) by 0 days.

(21) Appl. No.: 15/752,585

(22) PCT Filed: Oct. 31, 2016

(86) PCT No.: PCT/CN2016/104122
§ 371 (c)(1),
(2) Date: Feb. 14, 2018

(87) PCT Pub. No.: WO2017/076262
PCT Pub. Date: May 11, 2017

(65) Prior Publication Data

US 2018/0245425 A1 Aug. 30, 2018

(30) Foreign Application Priority Data

Nov. 2, 2015 (CN) ..... 2015 1 0733677

(51) Int. Cl.
*E21B 41/04* (2006.01)
*E21B 34/04* (2006.01)
(Continued)

(52) U.S. Cl.
CPC ..... *E21B 34/04* (2013.01); *E21B 33/0355* (2013.01); *E21B 33/043* (2013.01);
(Continued)

(58) Field of Classification Search
CPC ..... E21B 41/04
See application file for complete search history.

(56) References Cited

U.S. PATENT DOCUMENTS 4,732,215 A * 3/1988 Hopper ..... E21B 41/08 166/341
6,109,352 A * 8/2000 Edwards ..... E21B 33/035 166/336
(Continued)

FOREIGN PATENT DOCUMENTS

CN 102027190 4/2011
CN 201902656 7/2011
(Continued)

OTHER PUBLICATIONS

"International Search Report (Form PCT/ISA/210)", dated Feb. 7, 2017, with English translation thereof, pp. 1-6.

*Primary Examiner* — Matthew R Buck
*Assistant Examiner* — Aaron L Lembo
(74) *Attorney, Agent, or Firm* — JCIPRNET

(57) ABSTRACT

A moving-rotating linear covering tool, comprising a port, a primary oil cylinder, a piston rod, a rear end cover, a base sleeved on the right end of the primary oil cylinder, and a handle fixedly connected onto the outer cylinder of the base. The port is fixedly connected to the left end of the primary oil cylinder, the center thereof being provided with a circular hole that clearance-fits the piston rod arranged in the primary oil cylinder. A circular flange of the rear end cover is fixedly connected onto the right end face of the primary oil cylinder. The base is connected to a guide supporting sheath sleeved, in a clearance-fitted way, on the outer cylinder of
(Continued)

the primary oil cylinder. A bearing seat is provided on the right end wall of the base Two screw holes are symmetrically provided at the right end face of the rear end cover.

10 Claims, 1 Drawing Sheet

(51) Int. Cl.
*E21B 43/013* (2006.01)
*E21B 33/035* (2006.01)
*E21B 33/043* (2006.01)
*E21B 34/16* (2006.01)

(52) U.S. Cl.
CPC ..... *E21B 34/16* (2013.01); *E21B 41/04* (2013.01); *E21B 43/013* (2013.01)

(56) References Cited

U.S. PATENT DOCUMENTS 6,460,621 B2 * 10/2002 Fenton ..... E21B 33/035 166/347
6,474,416 B2 * 11/2002 Beall ..... E21B 33/035 166/343
6,817,417 B2 * 11/2004 Blair ..... E21B 33/037 166/335
6,845,815 B2 * 1/2005 Hergarden ..... E21B 33/037 166/75.13
7,296,629 B2 * 11/2007 Bartlett ..... E21B 33/038 166/339
7,325,598 B2 * 2/2008 Bartlett ..... E21B 33/038 166/75.13
7,677,319 B2 * 3/2010 Baskett ..... E21B 41/04 166/360
8,087,465 B2 * 1/2012 Huang ..... E21B 33/037 166/339
8,763,693 B2 * 7/2014 McHugh ..... E21B 33/076 166/250.01
8,992,127 B2 * 3/2015 Joensen ..... B63B 27/00 405/205
9,010,431 B2 * 4/2015 Billington ..... E21B 19/002 166/336
9,188,499 B2 * 11/2015 Hayward ..... E21B 33/035
9,611,714 B2 * 4/2017 Donald ..... E21B 33/038
9,702,215 B1 * 7/2017 Murphy ..... E21B 33/076
9,797,223 B1 * 10/2017 Gordon ..... E21B 41/0007
2008/0087436 A1 * 4/2008 Baskett ..... E21B 41/04 166/344
2011/0164926 A1 * 7/2011 Joensen ..... B63B 27/00 405/205
2012/0168169 A1 * 7/2012 Voss ..... E21B 33/0355 166/341
2013/0220625 A1 * 8/2013 Billington ..... E21B 19/002 166/336
2015/0075805 A1 * 3/2015 Donald ..... E21B 33/038 166/368
2015/0167268 A1 * 6/2015 Joensen ..... B63B 27/00 405/205
2017/0175478 A1 * 6/2017 Donald ..... E21B 33/038

FOREIGN PATENT DOCUMENTS

CN 102725573 10/2012
CN 105298442 2/2016
CN 205172517 4/2016
WO 2015044441 4/2015
WO 2015136234 9/2015

* cited by examiner

MOVING-ROTATING LINEAR COVERING TOOL

CROSS-REFERENCE TO RELATED APPLICATION

This application is a 371 of international application of PCT application serial no. PCT/CN2016/104122, filed on Oct. 31, 2016, which claims the priority benefit of China application no. 201510733677.0, filed on Nov. 2, 2015. The entirety of each of the above-mentioned patent applications is hereby incorporated by reference herein and made a part of this specification.

BACKGROUND

Technical Field

The present invention relates to a moving-rotating linear covering tool, which is a valve operating tool operated on a valve on a subsea tree. The present invention belongs to the technical field of offshore oil production.

Description of Related Art

The main structure of a linear covering tool is a one-way cylinder having a port for fixed connection with a valve on a tree. It is a tool for opening or closing a valve on a subsea tree. The device conforms to standards that it can be carried and operated by a robot.

A subsea tree is a wellhead control device used in oil/gas tests after completion of an oil (gas) well or used in oil production of a flowing well. A valve is provided on the tree and used for control and adjustment of the production of an oil well, routine maintenance like paraffin removal, and so on. To control the valve on the tree, a robot is generally used to carry a covering tool and moves along an oil production pipeline to a working platform specially built for the robot beside the tree. After the robot is positioned and fixed by itself on the platform, the covering tool is fixed on a valve seat in a manner similar to the way that a fire hydrant is connected and fixed to a fire hose on land. That is, the robot firstly aligns grooves on a port of the covering tool with grooves on a port of the valve seat, inserts the covering tool to the bottom of the port of the valve seat, and then rotates the covering tool till the grooves on the covering tool are engaged with teeth on the valve seat, such that the linear covering tool is fixed with the valve. After fixing of the covering tool and the valve, the one-way cylinder starts working under the operation of the robot. A piston rod of the cylinder moves forward to push the valve plug, so as to open or close the valve on the tree. After the cylinder finishes working, the piston rod returns, and the robot reversely rotates the covering tool to release the engagement between the grooves and the teeth and draws the covering tool out of the valve seat.

Therefore, when the tool is used to manipulate the valve, the robot is required to be positioned and fixed by itself and at the same time, to move and insert the covering tool into the valve port and enable the covering tool to rotate about the valve seat. The robot system is too complex, and the risk of failures in the robot is increased, so that the reliability of the robot is reduced, the price of the robot increases due to more degrees of freedom, and the economical efficiency of the robot is largely reduced.

SUMMARY

In the present invention, by increasing the degrees of freedom of a covering tool, after a robot is positioned and fixed by itself, a port of the covering device carried by the robot is aligned with a valve on a subsea tree; the covering tool is automatically fixed to a valve seat through automatic control, and then opens or closes the valve on the subsea tree. Therefore, the control system of the robot is largely simplified, the reliability of the system is increased, and the inspection and maintenance costs of the subsea tree are reduced.

To achieve the above objective, the present invention is implemented by using the following technical solution.

A moving-rotating linear covering tool includes a port 1, a primary oil cylinder 2, a piston rod 21, a rear end cover 22, a base 11, and a handle 3. The port 1 is fixedly connected to the left end of the primary oil cylinder 2, the center of the port 1 being provided with a circular hole that clearance-fits the piston rod 21 arranged in the primary oil cylinder 2. A circular flange of the rear end cover 22 is fixedly connected onto the right end face of the body of the primary oil cylinder 2. Being a housing with a U-shaped section, the base 11 is sleeved on the right end of the primary oil cylinder 2, and is connected to a guide supporting sheath 12 that is sleeved, in a clearance-fitted way, on the outer cylinder of the primary oil cylinder 2. The handle 3 is fixedly connected onto the outer cylinder of the base 11. A bearing seat 112 having a stepped hole with large diameter on the right and small diameter on the left is provided on the right end wall of the base 11. Two screw holes 221 are symmetrically provided at the right end face of the rear end cover 22. By means of the bearing seat 112 and the two screw holes 221, a rotating mechanism that rotates the primary oil cylinder 2 with respect to the base 11 around an axis and a moving mechanism that moves the primary oil cylinder 2 with respect to the base 11 towards the left or right along the axial direction are provided in turn from outside to inside.

The rotating mechanism includes a rotary oil cylinder 8, rotary arms 4, a rotary disc 6, a bearing 7, a coupling 9, and a retainer ring 10. The rotary arms 4 are two cylinders each provided on one end with a hexagon head and a thread in connection with a screw hole 221 on the rear end cover 22. Two grooves 62 allowing insertion of the other ends of rotary arms 4 are symmetrically provided on the circumference of the rotary disc 6. A rotary shaft having, sequentially from left to right, a separation segment 63, a bearing segment 64 and a coupling segment 66 with large, medium and small diameters respectively is provided at the center of the right end of the rotary disc 6. A retainer ring groove 65 for installing the retainer ring 10 is further provided on the circumference, close to the right end face, of the bearing segment 64 having the medium diameter. The bearing 7 is fixed in the small-diameter hole of the bearing seat 112. The rotary shafts of the rotary disc 6 pass through the bearing 7 from left to right, the left end of the bearing 7 is closely attached to the right end face of the separation segment 63, and the right end of the bearing 7 is closely attached to the retainer ring 10 installed in the retainer ring groove 65. The rotary oil cylinder 8 is fixedly connected to the right end face of the base 11 through a flange. The coupling 9 is arranged in the large-diameter hole of the bearing seat 112, the left-end inner hole of the coupling 9 is in keyed connection with the coupling segment 66 of the rotary shaft, and the right end of the coupling 9 is connected to a cylinder rotary shaft 81 of the rotary oil cylinder 8.

The moving mechanism includes a movable oil cylinder 5, a companion flange 51, and a movable piston rod 52. The right end face of the movable oil cylinder 5 is fixedly connected to the center of the left end face of the rotary disc 6. A ball head is provided on the end of the movable piston rod 52, and is connected to the right end face of the rear end cover 22 through the companion flange 51.

The moving stroke of the movable oil cylinder 5 is 26 mm, which is equal to the working height of the port 1 plus a margin of 5 mm.

The rotation angle of the rotary cylinder 8 is 0 to 45°±1°.

The coupling 9 is an elastic coupling.

The elastic coupling is a slider coupling.

The bearing 7 is a roller bearing or needle bearing.

Several auxiliary holes 111 are formed on the circumferential wall of the base 11.

The port 1 is a standard type-A port, conforming to the GB/T21412-2010 standard, and the handle 3 is a type-B handle, conforming to the GB/T21412-2010 standard.

The present invention has the following beneficial effects:

In the present invention, by increasing the degrees of freedom of the covering tool, after an underwater robot is positioned and fixed by itself on a platform beside a tree, it is designed to make an axis of the port 1 of the covering tool automatically coincide with an axis of a valve port of the tree, and the port of the covering device carried by the robot is aligned with the valve on the subsea tree. Under an external instruction, the covering tool can automatically connect and fix its port with the valve port on the tree by using the moving mechanism and the rotating mechanism carried in the covering tool, and then opens or closes the valve on the subsea tree through the primary oil cylinder. Therefore, the robot system is largely simplified, the reliability of the whole system is increased, the purchasing cost of the robot is reduced, and the inspection and maintenance costs of the valve of the subsea tree are reduced.

It is ensured through a reasonable design of positions that, during working of the robot carrying the covering tool, when the rotary oil cylinder 8 rotates anticlockwise to a limit position, the rotary arms 4 are forced to rotate by the rotary disc 6, such that the position of the port 1 is corresponding to a connecting position of the valve port of the tree, and the port 1 can be successfully inserted to the bottom of the valve port of the tree; while when the rotary oil cylinder 8 rotates clockwise to a limit position, the position of the port 1 is corresponding to a locking position of the valve port of the tree.

In addition, the rotary disc 6 serves as an executing element of the rotating mechanism to force the primary oil cylinder 2 to rotate, and also serves as a fixed seat of the movable oil cylinder 5. Therefore, the product structure is more concise and compact, and the reliability of the product is further increased.

Figure 1:
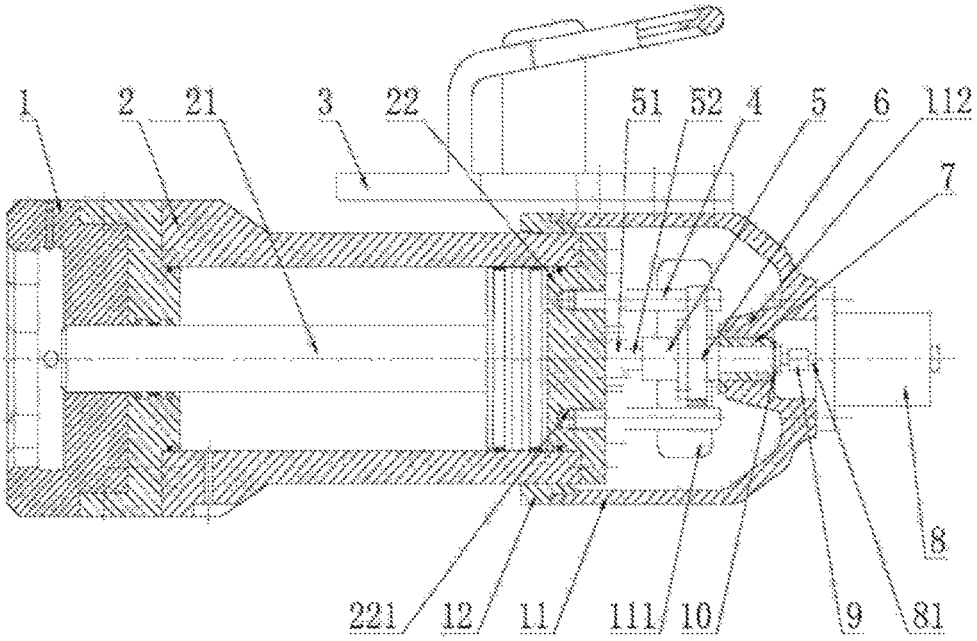
FIG. 1 is a schematic structural diagram of a moving-rotating linear covering tool according to the present invention.

In the drawings: 1. port, 2. primary oil cylinder, 21. piston rod, 22. rear end cover, 221. screw hole, 3. handle, 4. rotary arm, 5. movable oil cylinder, 51. companion flange, 52. movable piston rod, 6. rotary disc, 62. rotary groove, 63. separation segment, 64. bearing segment, 65. retainer ring groove, 66. coupling segment, 67. threaded hole, 7. bearing, 8. rotary oil cylinder, 81. cylinder rotary shaft, 9. coupling, 10. retainer ring, 11. base, 111. auxiliary hole, 112. bearing seat, 12. guide supporting sheath.

DESCRIPTION OF THE EMBODIMENTS

In order to make the objective and the technical solution of the present invention clearer, the technical solution of the present invention is further described below with reference to the accompanying drawings.

Persons skilled in the art can understand that, unless being particularly defined, all the terms used herein, including technical terms and scientific terms, have the same meanings as commonly understood by persons of ordinary skill in the art.

The terms "left" and "right" in the present invention refer to directions relative to a reader in front of a figure, "left" means the left side of the reader and "right" means the right side of the reader. They do not form limitations on the present invention.

The term "connection" in the present invention may refer to direct connection between parts or indirect connection between parts by means of other parts.

Figure 2:
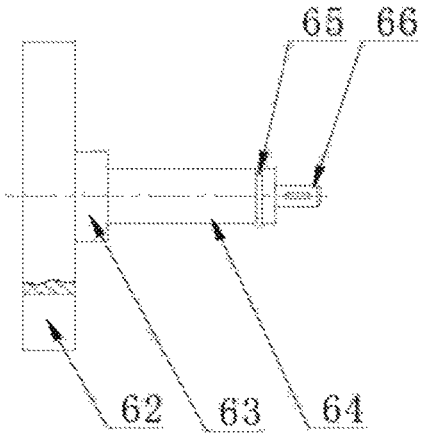
FIG. 2 is a front view of a rotary disc 6 in FIG. 1.
Figure 3:
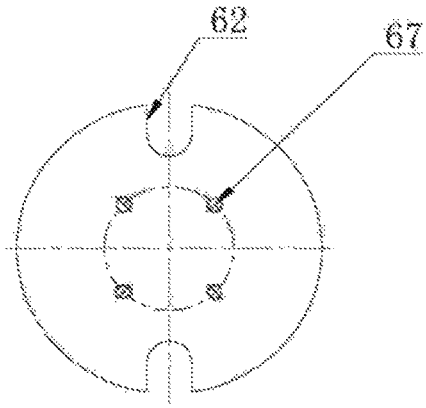
FIG. 3 is a left view of the rotary disc 6 in FIG. 2.

As shown in FIG. 1, FIG. 2, and FIG. 3, a moving-rotating linear covering tool includes a port 1, a primary oil cylinder 2, a piston rod 21, a rear end cover 22, a base 11, and a handle 3. The port 1 is of type-A, conforming to the GB/T21412-2010 standard. The port 1 is fixedly connected to the left end of the primary oil cylinder 2, the center of the port 1 being provided with a circular hole that clearance-fits the piston rod 21 arranged in the primary oil cylinder 2. A circular flange of the rear end cover 22 is fixedly connected onto the right end face of the body of the primary oil cylinder 2. The base 11 is a housing with a U-shaped section and has auxiliary holes 111 formed on the circumference thereof. The base 11 is sleeved on the right end of the primary oil cylinder 2, and is connected to a guide supporting sheath 12 that is sleeved, in a clearance-fitted way, on the outer cylinder of the primary oil cylinder 2. The handle 3 is of type-B, conforming to the GB/T21412-2010 standard. The handle 3 is fixedly connected onto the outer cylinder of the base 11. A bearing seat 112 having a stepped hole with large diameter on the right and small diameter on the left is provided on the right end wall of the base 11. Two screw holes 221 are symmetrically provided at the right end face of the rear end cover 22. By means of the bearing seat 112 and the two screw holes 221, a rotating mechanism that rotates the primary oil cylinder 2 with respect to the base 11 around an axis and a moving mechanism that moves the primary oil cylinder 2 with respect to the base 11 towards the left or right along the axial direction are provided in turn from outside to inside.

The rotating mechanism that controls the primary oil cylinder 2 includes rotary arms 4, a rotary disc 6, a bearing 7, a retainer ring 10, a coupling 9, and a rotary oil cylinder 8. The rotary arms 4 are two cylinders each provided on one end with a hexagon head and a thread in connection with a screw hole 221 on the rear end cover 22. Two grooves 62 allowing insertion of the other ends of rotary arms 4 are symmetrically provided on the circumference of the rotary disc 6. A rotary shaft having, sequentially from left to right, a separation segment 63, a bearing segment 64 and a coupling segment 66 with large, medium and small diameters respectively is provided at the center of the right end of the rotary disc 6. A retainer ring groove 65 for installing the retainer ring 10 is further provided on the circumference, close to the right end face, of the bearing segment 64 having the medium diameter. The bearing 7 is fixed in the small-diameter hole of the bearing seat 112. The rotary shafts of the rotary disc 6 pass through the bearing 7 from left to right. The bearing 7 is a roller bearing or needle bearing. The left end of the bearing 7 is closely attached to the right end face of the separation segment 63, and the right end of the bearing 7 is closely attached to the retainer ring 10 installed in the retainer ring groove 65. The rotary oil cylinder 8 is fixedly connected to the right end face of the base 11 through a flange. The coupling 9 is a slider coupling, and is arranged in the large-diameter hole of the bearing seat 112. The left-end inner hole of the coupling 9 is in keyed connection with the coupling segment 66 of the rotary shaft, and the right end of the coupling 9 is connected to a cylinder rotary shaft 81 of the rotary oil cylinder 8. The right end face of the flange of the rotary oil cylinder 8 is fixed on a flange at the right end of the base 11, and the rotation angle of the rotary oil cylinder 8 is 0 to 45°.

The moving mechanism that controls the primary oil cylinder 2 includes a movable oil cylinder 5, a companion flange 51, and a movable piston rod 52. The right end face of the body of the movable oil cylinder 5 is fixedly connected to the center of the left end face of the rotary disc 6 by means of threaded holes 67 on the rotary disc 6. The maximum working stroke of the movable oil cylinder 5 is 26 mm. A ball head is provided on the end of the movable piston rod 52, and is connected to the right end face of the rear end cover 22 through the companion flange 51. To ensure that the movable oil cylinder 5 in working does not interfere with the rotating mechanism, the rotary arms 4 should be long enough to be completely embedded in the rotary grooves 62 of the rotary disc 6 when the movable piston rod 52 of the movable oil cylinder 5 extends to the maximum extent.

After the moving-rotating linear covering tool of the present embodiment is installed, the axes of the port 1-primary oil cylinder 2-movable oil cylinder 5-base 11-rotary oil cylinder 8 coincide with each other. After a robot aligns the port 1 of the tool with a valve port of a tree, by using the tool, when the rotary oil cylinder 8 rotates anticlockwise to a limit position (0°), the position of the port 1 is corresponding to the position of the valve port on the tree, and the movable oil cylinder 5 moves forward by 26 mm, such that the port 1 can be inserted to the bottom of the valve port on the tree. Meanwhile, it is ensured that when the rotary oil cylinder 8 rotates clockwise to a limit position (45°), the port 1 is locked with the valve port on the tree.

Working Principle:

In the present invention, the movable oil cylinder 5 in the moving-rotating linear covering tool is fixed at the center of the rotary disc 6, and the ball head of the piston rod 52 is fixed on the rear end cover 22 through the companion flange 51. The primary oil cylinder 2 is pushed and pulled to slide towards the left or right in the guide supporting sheath 12, and meanwhile the rotary arms 4 also slide in the rotary grooves 62 of the rotary disc 6, such that the torque transmission of the rotary oil cylinder is not affected, and the port 1 can be inserted or removed.

The rotary oil cylinder 8 forces the rotary disc 6 to rotate through the coupling 9, and with the rotation of the rotary disc 6, the rotary arms 4 embedded in the rotary grooves 62 force the primary oil cylinder 2 to rotate in the guide supporting sheath 12, such that the port can be locked through rotation.

An underwater robot carries the moving-rotating linear covering tool and moves along an oil production pipeline to a working platform specially built for the robot beside a tree. After the robot is positioned and fixed by itself on the platform, an axis of the port 1 of the covering tool automatically coincides with an axis of a valve port of the tree. The covering tool operates under the control of an external instruction. In a first step, the angle of the port 1 is reset, the rotary oil cylinder 8 rotates anticlockwise to a stopping point, and the pressure of the rotary oil cylinder 8 is maintained. In a second step, the movable oil cylinder 5 works, and the piston rod moves to rapidly push the port 1 on the covering tool into the valve port on the tree. Then, the movable oil cylinder 5 automatically stops working, and the pressure of the system is maintained. In a third step, the rotary oil cylinder 8 after anticlockwise rotation is released from the pressure maintaining state, and rotates clockwise by 45° to automatically stop pressure maintaining. The movable oil cylinder 5 is released from the pressure maintaining state. The system completes abutting and locking of the linear covering tool with the valve port of the subsea tree. The primary oil cylinder 2 starts working, and the piston rod 21 moves leftward to push the valve spindle of the tree till the valve is opened or closed. The pressure of the system is maintained. After the primary oil cylinder 2 finishes working, the moving-rotating linear covering tool is separated from the valve port of the subsea tree according to a reverse procedure. The robot returns to the water surface.

What is claimed is:

1. A moving-rotating linear covering tool, comprising a port, a primary oil cylinder, a piston rod, a rear end cover, a base, and a handle, a first end of the port is fixedly connected to the left end of the primary oil cylinder, the center of the port being provided with a circular hole that clearance-fits the piston rod arranged in the primary oil cylinder; a circular flange of the rear end cover is fixedly connected onto the right end face of the body of the primary oil cylinder; being a housing with a U-shaped section, the base is sleeved on the right end of the primary oil cylinder, and is connected to a guide supporting sheath that is sleeved, in a clearance-fitted way, on the outer cylinder of the primary oil cylinder; the handle is fixedly connected onto the outer cylinder of the base; characterized in that a bearing seat having a stepped hole with large diameter on the right and small diameter on the left is provided on the right end wall of the base, two screw holes are symmetrically provided at the right end face of the rear end cover; and by means of the bearing seat and the two screw holes, a rotating mechanism that rotates the primary oil cylinder with respect to the base around an axis and a moving mechanism that moves the primary oil cylinder with respect to the base towards the left or right along the axial direction are provided in turn from outside to inside, wherein a second end of the port connects with a valve port of a subsea tree.

2. The moving-rotating linear covering tool according to claim 1, characterized in that, the rotating mechanism comprises a rotary oil cylinder, rotary arms, a rotary disc, a bearing, a coupling, and a retainer ring; the rotary arms are two cylinders each provided on one end with a hexagon head and a thread in connection with a screw hole on the rear end cover; two grooves allowing insertion of the other ends of rotary arms are symmetrically provided on the circumference of the rotary disc, a rotary shaft having, sequentially from left to right, a separation segment, a bearing segment and a coupling segment with large, medium and small diameters respectively is provided at the center of the right end of the rotary disc, and a retainer ring groove for installing the retainer ring is further provided on the circumference, close to the right end face, of the bearing segment having the medium diameter; the bearing is fixed in the small-diameter hole of the bearing seat; the rotary shafts of the rotary disc pass through the bearing from left to right, the left end of the bearing is closely attached to the right end face of the separation segment, and the right end of the bearing is closely attached to the retainer ring installed in the retainer ring groove; the rotary oil cylinder is fixedly connected to the right end face of the base through a flange; the coupling is arranged in the large-diameter hole of the bearing seat, the left-end inner hole of the coupling is in keyed connection with the coupling segment of the rotary shaft, and the right end of the coupling is connected to a cylinder rotary shaft of the rotary oil cylinder.

3. The moving-rotating linear covering tool according to claim 2, characterized in that, the rotation angle of the rotary oil cylinder is 0 to 45°±1°.

4. The moving-rotating linear covering tool according to claim 2, characterized in that, the coupling is an elastic coupling.

5. The moving-rotating linear covering tool according to claim 4, characterized in that, the elastic coupling is a slider coupling.

6. The moving-rotating linear covering tool according to claim 2, characterized in that, the bearing is a roller bearing or needle bearing.

7. The moving-rotating linear covering tool according to claim 1, characterized in that, the moving mechanism comprises a movable oil cylinder, a companion flange, and a movable piston rod, the right end face of the movable oil cylinder is fixedly connected to the center of the left end face of the rotary disc; a ball head is provided on the end of the movable piston rod, and is connected to the right end face of the rear end cover through the companion flange.

8. The moving-rotating linear covering tool according to claim 7, characterized in that, the moving stroke of the movable oil cylinder is 26 mm, which is equal to the working height of the port plus a margin of 5 mm.

9. The moving-rotating linear covering tool according to claim 1, characterized in that, several auxiliary holes are formed on the circumferential wall of the base.

10. The moving-rotating linear covering tool according to claim 1, characterized in that, the port is a standard type-A port, conforming to the GB/T21412-2010 standard, and the handle is a type-B handle, conforming to the GB/T21412-2010 standard.

* * * * *